US007918335B1

(12) United States Patent
Kitchen

(10) Patent No.: US 7,918,335 B1
(45) Date of Patent: Apr. 5, 2011

(54) ELECTROMAGNETIC SHIELDING CARRYING CASE FOR CONTACTLESS SMARTCARDS AND PERSONAL ARTICLES

(76) Inventor: Michael Kitchen, Media, PA (US)

( * ) Notice: Subject to any disclaimer, the term of this patent is extended or adjusted under 35 U.S.C. 154(b) by 0 days.

(21) Appl. No.: 12/660,561

(22) Filed: Mar. 1, 2010

(51) Int. Cl.
*A45C 11/18* (2006.01)
*A45C 15/00* (2006.01)
*H05K 9/00* (2006.01)

(52) U.S. Cl. ..... 206/38; 206/39; 206/449; 150/132; 150/147; 174/353; 174/386

(58) Field of Classification Search ..... 206/1.5, 206/37–39, 449; 150/131, 132, 147, 149; 174/350, 353, 372, 377, 386; 235/380, 382, 235/486; 361/757, 800, 816, 818
See application file for complete search history.

(56) References Cited

U.S. PATENT DOCUMENTS 5,423,363 A * 6/1995 Matzdorff et al. ..... 150/143
5,941,375 A * 8/1999 Kamens et al. ..... 206/38
6,121,544 A * 9/2000 Petsinger ..... 174/353
6,601,622 B1 * 8/2003 Young ..... 150/138
6,892,880 B2 * 5/2005 Nieves ..... 206/320
7,482,925 B2 1/2009 Hammad et al.
7,830,672 B1 * 11/2010 Kitchen ..... 235/486
2007/0284264 A1 * 12/2007 Davis ..... 206/39
2008/0149525 A1 * 6/2008 Horiuchi et al. ..... 206/449
2008/0190526 A1 * 8/2008 O'Shea ..... 150/147

* cited by examiner

*Primary Examiner* — Luan K Bui

(57) ABSTRACT

An electromagnetic shielding carrying case comprising a substantially rigid first and second shielding member hingedly connected to one another and each having an inner and outer surface. Each shielding member comprises a card pocket assembly affixed to their respective inner surfaces into which a plurality of contactless smartcards or regular wallet-sized cards can be slidably inserted and removed. A paper currency pocket is disposed along the outer surfaces of first and second shielding members, and a releasable locking means keeps the first shielding member pivoted closed over top of the second shielding member so the case cannot accidentally open, and shields contactless smartcards contained inside the card pocket assemblies from being powered up by an RFID reader, while also preventing the cards from sliding out of the case.

8 Claims, 6 Drawing Sheets

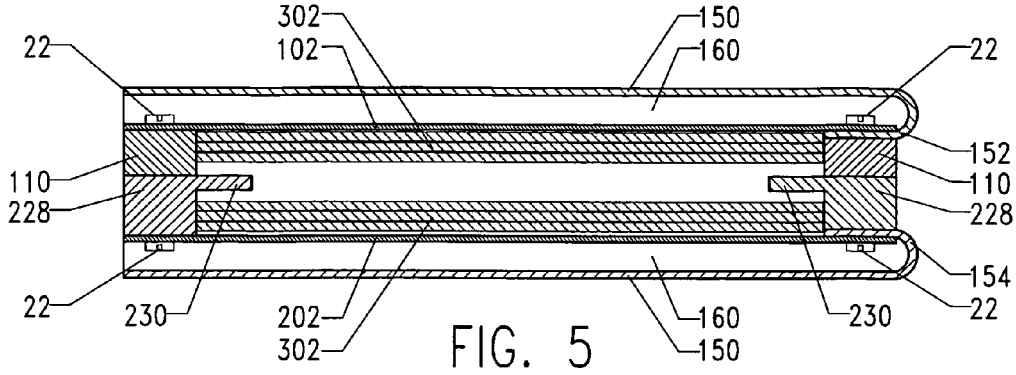
FIG. 5
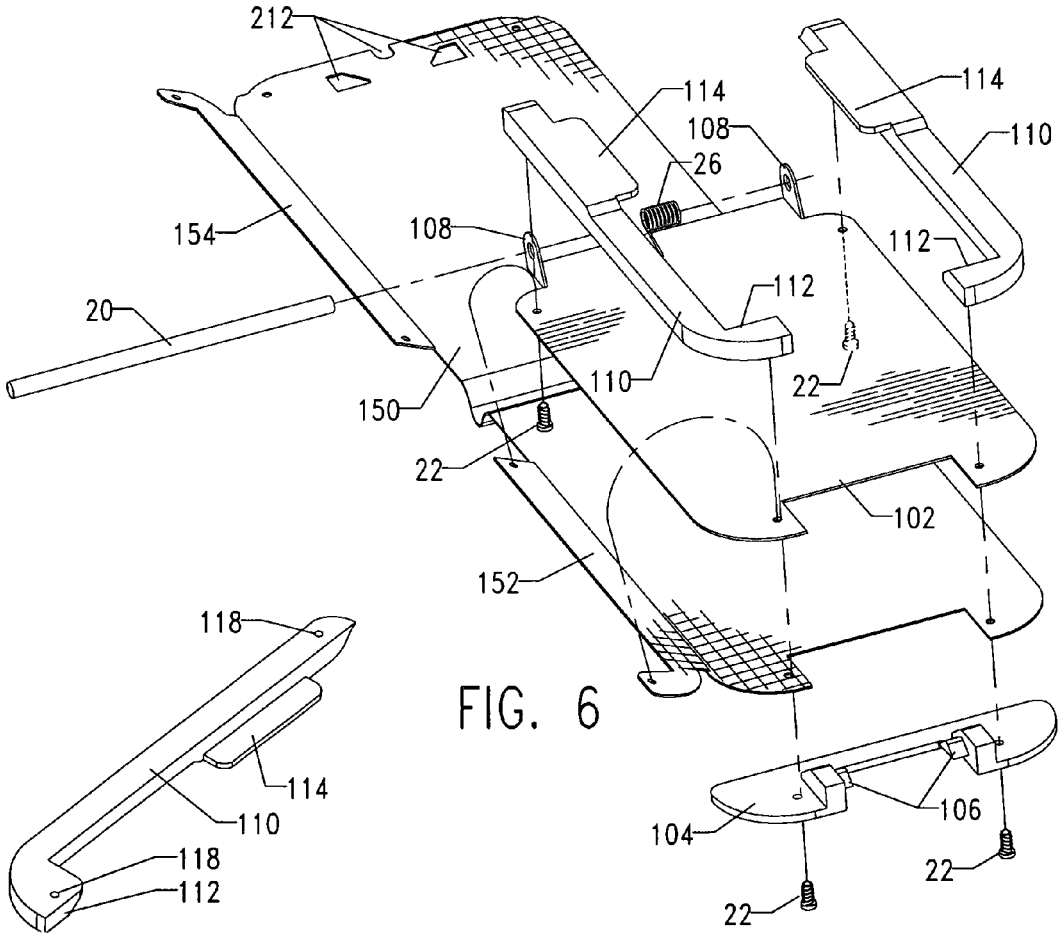
FIG. 6
FIG. 6A

ELECTROMAGNETIC SHIELDING CARRYING CASE FOR CONTACTLESS SMARTCARDS AND PERSONAL ARTICLES

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to carrying cases, and more specifically to wallet-sized electromagnetic shielding carrying cases for holding personal articles such as credit cards, contactless smartcards, licenses, identification cards, paper currency, receipts, tickets, and the like.

2. Prior Art

Contactless smartcards are wallet-sized cards that are being marketed to consumers as an alternative to magnetic strip cards as a convenient way for storing financial and personal data. By virtue of their ability to store relatively large amounts of data on an embedded microchip, and the convenience of not having to swipe the card through a scanner or hand it to a cashier, it is projected that these cards will only continue to multiply in the coming years in the fields of banking, transportation, healthcare, insurance, social security, and other personal data. The chips used in contactless smartcards can be manufactured in a form called an RFID chip, wherein RFID stands for Radio Frequency Identification. Contactless smartcards may also be referred to as RFID enabled cards.

In order to obtain the personal information contained on a smartcard, an RFID reader or sensor needs to be present. The RFID reader provides power to the embedded microchip via a modulated magnetic field, allowing the information to be obtained from the card. Assuming that the smartcards are not shielded by an electromagnetic-shielding enclosure, the smartcards can be powered up and accessed without the card owner's knowledge. This can typically occur in two different scenarios. In one scenario, the unauthorized scanning of an RFID enabled card can be accidental, wherein the card owner is unaware that they have come within range of an active RFID reader. In the second scenario, the scanning of the card might be intentionally executed by a party who is interested in obtaining the card owners personal information without their consent. This said party may have their own RFID reader which they use for this purpose. The latter scenario is an example of what has become known as RFID theft, a new and rapidly growing form of identity theft. In both of these scenarios, however, the user can no longer take a proactive role in securing information on their cards.

There are some who have invented methods of proactively securing the information on a smartcard. U.S. Pat. No. 6,121,544 issued to Petsinger describes an electromagnetic shield to prevent unauthorized access to contactless smartcards. The smartcard is inserted into an opaque sleeve that covers the majority of the cards surfaces. A sheet of electromagnetic-shielding material in the form of a soft magnetic alloy is embedded within the sleeve. While in the sleeve, a contactless smartcard is shielded from being powered up by an RFID reader. While it does provide a secure RFID shielding body in the form of the sleeve, the disadvantage of this device is that it is specifically made for a very small quantity of cards (typically one or two). The sleeve is meant to be carried in a users pocket or wallet, but this is unfavorable because it adds complication and time to removing RFID cards from a user's wallet. Moreover, because of the opaque nature of the electromagnetic-shielding material and its plastic shells, one cannot see through it. This prevents the user from seeing which card is stored inside the sleeve. Lastly, the sleeve does not have the capability to carry any additional personal items, such as paper currency, photographs, receipts, or other cards, making it a separate item that needs to be carried in addition to ones regular wallet.

Other solutions have been presented for shielding smartcards in the form of conventional leather and fabric bi-fold wallets with one or more liners of electromagnetic-shielding material embedded somewhere within or attached to their outer panels. One particular reference that describes this common solution is U.S. Pat. No. 7,482,925 issued to Visa U.S.A. (herein Visa). Visa discloses several methods and apparatuses for shielding portable consumer devices such as contactless smartcards, which include envelopes with metalized coatings, electromagnetic shielding stickers attached to smartcards, and a conventional bi-fold wallet with an "RF shield liner" that is configured to be integrated with the wallet to shield smartcards contained inside it. While most of the embodiments that Visa describes are temporary security measures to protect and shield newly issued smartcards during transport through the mail to their owners, Visa also teaches a fairly standard bi-fold wallet with an "RF shield liner" integrated with the outer panels of the wallet, and a holding pocket inside for containing smartcards. Visa states that the "RF shield liner" is configured to attenuate RF signals within the operation frequency range of the smartcard contained inside the holding pocket when the wallet is folded closed.

There are several serious issues with Visa's solution and with other RF shielding wallets that use this same method. First, it is evident that these electromagnetic shielding wallets are made to be carried in ones pocket or handbag. However, while these traditional bi-fold type wallets are in ones pocket or handbag they have a tendency to pivot open slightly as a result of the user walking, running, or being jolted. When these wallets fold open even the slightest bit, the RF shield liner on the outside of the wallet also spreads open, and a breach is created in the RF shielding effect of the wallet, making the smartcards prone to accidental or unauthorized scanning.

A second disadvantage of these RF blocking wallets is the fact that the card pockets within them are not closed off in any way, even when the wallet is folded closed. Again, as a result of the user walking, running, or being jolted in some way, the smartcards within the wallet are prone to sliding out of the sleeves, and even the slightest exposure of these smartcards outside of the RF shield liner can risk unauthorized and accidental scanning of the smartcard.

A third disadvantage to these RF blocking wallets is that the RF shielding liner inside needs to be flexible and is often substantially thin and flimsy, using materials such as aluminum foil. As a result of repeatedly folding open and closed with use, and being subjected to various forces while in ones pocket or bag, these RF shielding liners can easily crumple, tear, or crack, which can lead to a creation of a hole or gap in the electromagnetic shielding effect of the wallet.

A fourth disadvantage to these RF blocking wallets is the added labor and cost of manufacturing and constructing them. The RF shielding liner becomes a costly appendage to the wallet instead of being an efficient, integral component. Not only does the leather or fabric have to be cut down to size and sewn together, but sheets of electromagnetic-shielding material have to be fabricated and cut down to size as well, only to be concealed within the outer panels of the wallet. It is an added cost and step in the manufacturing process that is often reflected in the retail price for these wallets.

Hence, there exists a need for a portable electromagnetic-shielding wallet or case that holds and shields a plurality of smartcards in more than one sleeve or pocket and is prevented from accidentally pivoting open while closed in ones pocket or bag. Moreover, smartcards contained inside the proposed electromagnetic-shielding wallet or case must not be able to slide or fall out when the wallet or case is closed.

In addition to being able to hold a plurality of smartcards or regular wallet-sized cards, the proposed wallet/carrying case must also be able to hold paper currency, receipts, tickets, and the like. Lastly, the materials used to create the electromagnetic shielding elements for the wallet or case must be substantially rigid, durable, and configured in a way so as to protect them from being folded, bent or broken over time with use.

SUMMARY OF THE INVENTION

The present invention is directed towards an improved electromagnetic shielding carrying case for contactless smartcards and personal articles that is meant to be carried in ones pocket, bag, or purse, comprising a substantially rigid first and second shielding member hingedly connected to one another and each having an inner and outer surface. Each shielding member comprises a card pocket assembly affixed to their respective inner surfaces into which a plurality of contactless smartcards or regular wallet-sized cards can be slidably inserted and removed. A piece of fabric is attached to a portion of the outer surfaces of the first and second shielding members and also has a folded portion that wraps onto a portion of the inner surfaces of the shielding members, defining a paper currency pocket into which paper currency, receipts, tickets, and the like can be inserted. A releasable locking means keeps the first shielding member pivoted closed over top of the second shielding member so the case cannot accidentally open, thus shielding contactless smartcards contained inside the card pocket assemblies from being powered up by an RFID reader, and preventing the cards from falling out of the case.

It is a primary objective of this invention to provide an electromagnetic shielding carrying case that shields a plurality of contactless smartcards contained within from being powered up and read by an RFID reader when the case is closed, and also prevent accidental opening while contained in ones pocket or bag by providing a releasable locking means that allows a user to quickly and easily lock the case shut.

It is another objective of this invention to provide electromagnetic shielding members that are durable and resilient, and to configure them in a way so as not to bend, tear, or degrade over time with normal use, which could consequently create a breach in the electromagnetic shielding effect.

It is another objective of this invention to provide an urging means to allow the carrying case to automatically pivot itself open when the releasable locking means is disengaged to hold itself open for the user while they sort through cards or hold a smartcard up to an RFID sensor.

It is another objective of this invention to provide a separate compartment within the electromagnetic shielding carrying case to store paper currency, receipts, tickets, and the like.

It is still another objective of this invention to provide several card pockets within the carrying case that allow a user maximum visibility of and better access to the cards contained in each card pocket.

BRIEF DESCRIPTION OF THE DRAWINGS

FIG. 5 illustrates schematically a vertical section through the center of the short dimension of the electromagnetic shielding carrying case.

FIG. 6 illustrates schematically an exploded axonometric view of the front panel assembly.

FIG. 6A illustrates schematically the underside of one of the front panel wall members.

Figure 1:
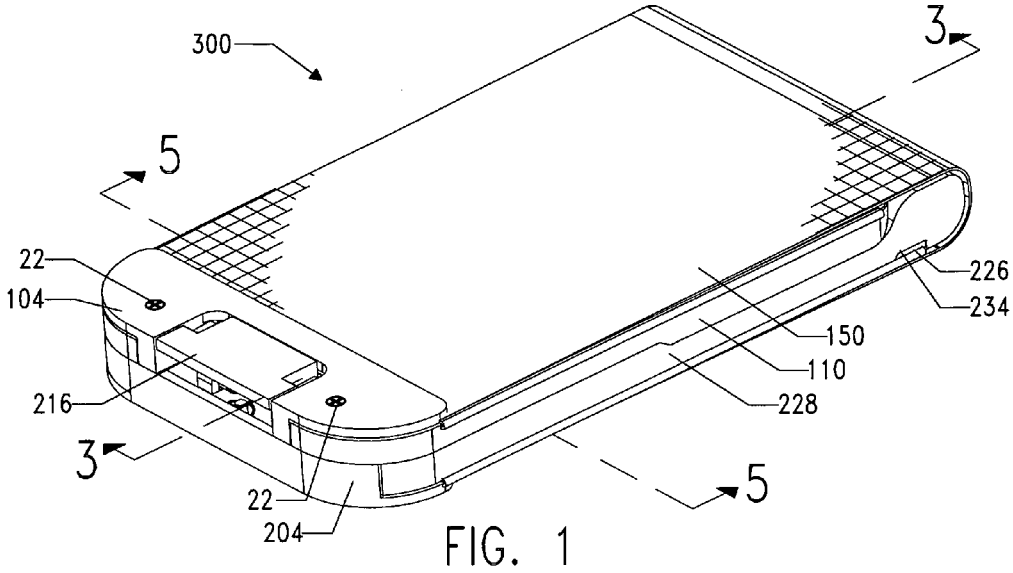
FIG. 1 illustrates schematically an axonometric view of the front side of the electromagnetic shielding carrying case when it is in its closed state.

| DRAWINGS—Reference Numerals | |
|---|---|
| 20 | hinge pin |
| 22 | self tapping screws |
| 24 | compression spring |
| 26 | torsion spring |
| 100 | front panel assembly |
| 102 | first shielding member |
| 104 | front edge plate |
| 106 | projecting tongues |
| 108 | hinge members on first shielding member |
| 110 | front panel wall members |
| 112 | ramp members |
| 114 | projecting tabs |
| 116 | first card pocket |

-continued

| DRAWINGS—Reference Numerals | |
|---|---|
| 118 | screw bosses |
| 150 | fabric piece |
| 152 | front folded portion |
| 154 | rear folded portion |
| 160 | paper currency pocket |
| 200 | rear panel assembly |
| 202 | second shielding member |
| 204 | rear edge plate |
| 206 | hinge members on rear edge plate |
| 208 | latch member pivot stop |
| 210 | first spring boss |
| 212 | cutouts in fabric |
| 214 | cutouts in second shielding member |
| 216 | latch member |
| 218 | second spring boss |
| 220 | tongue overlapping portion |
| 222 | hinge rods on latch member |
| 224 | rear panel ramp member |
| 226 | projecting arms |
| 228 | rear panel wall members |
| 230 | projecting tabs |
| 232 | counter-bored holes |
| 234 | notches in rear panel wall members |
| 236 | second card pocket |
| 238 | screw bosses |
| 300 | electromagnetic shielding carrying case |
| 302 | plurality of contactless smartcards |

DETAILED DESCRIPTION OF THE PREFERRED EMBODIMENTS

As used herein, the term "contactless smartcards" is meant to include any wallet-sized card, such as license, credit, check, ATM, or membership cards that are approximately 8.5 cm long by 5.5 cm wide and 1 mm or less thick and contain an RFID microchip within them that stores personal data. The electromagnetic shielding carrying case which is the preferred embodiment of the present invention is broadly denoted by the numeral 300 and is shown in its closed state in FIG. 1, in its open state in FIG. 1A, and turned sideways while in its open state in FIG. 2 to display paper currency pocket 160. Electromagnetic shielding carrying case 300 is preferably built in two parts—front panel assembly 100 is built first and then connected to rear panel assembly 200.

Front Panel Assembly

Figure 7:
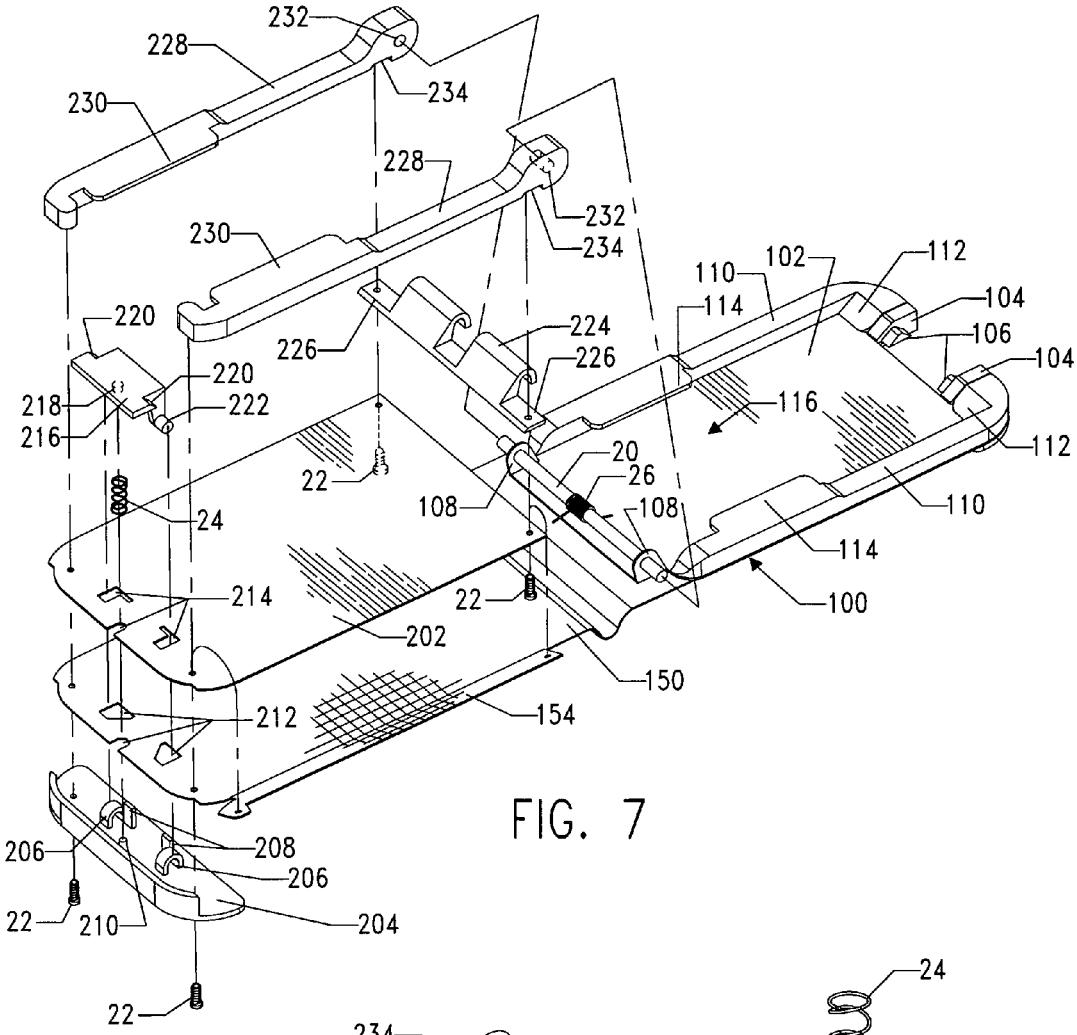
FIG. 7 illustrates schematically a partially exploded axonometric view of the rear panel assembly and how its hingedly connected to the front panel assembly.
Figure 7A:
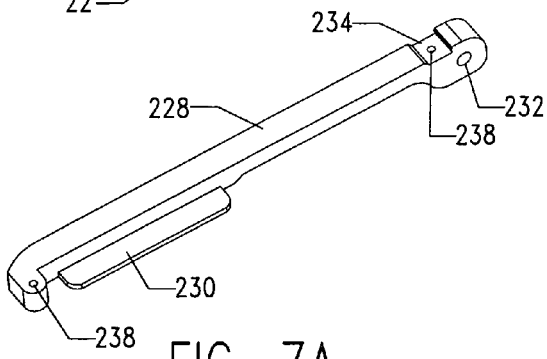
FIG. 7A illustrates schematically the underside of one of the rear panel wall members.
Figure 7B:
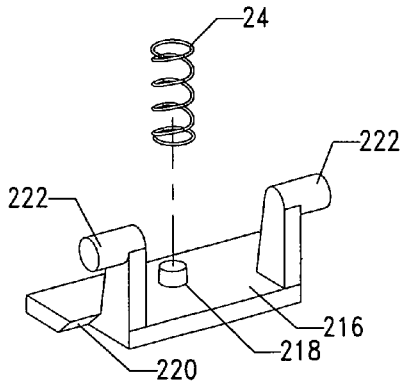
FIG. 7B illustrates schematically the underside of the latch member showing how the compression spring placed around the second spring boss.

Front panel assembly 100, as seen in part of FIG. 7 and exploded in FIG. 6, comprises a first shielding member 102 having a planar four sided shape and an inner and outer surface with a pair of hinge members 108 at one end. A portion of fabric piece 150 is placed against the outer surface of first shielding member 102 and has a front folded portion 152 which is folded over onto the inner surface of first shielding member 102 wherein holes in fabric piece 150, holes in first shielding member 102, and holes in front folded portion 152 are all aligned with each other. Self tapping screws 22 pass through holes in a front edge plate 104, fabric piece 150, first shielding member 102, and front folded portion 152 and fasten to screw bosses 118 in the underside of front panel wall members 110, thus connecting all the same together, as shown in FIG. 6.

Front panel wall members 110 are generally parallel to each other and sit on top of the inner surface of first shielding member 102. Front panel wall members 110 each have a projecting tab 114 projecting over top of the inner surface of first shielding member 102. Ramp members 112 are protruding from the ends of front panel wall members 110 and align with a portion of front edge plate 104. Torsion spring 26 sits in between hinge members 108 as a hinge pin 20 is inserted through all of the same.

Figure 1A:
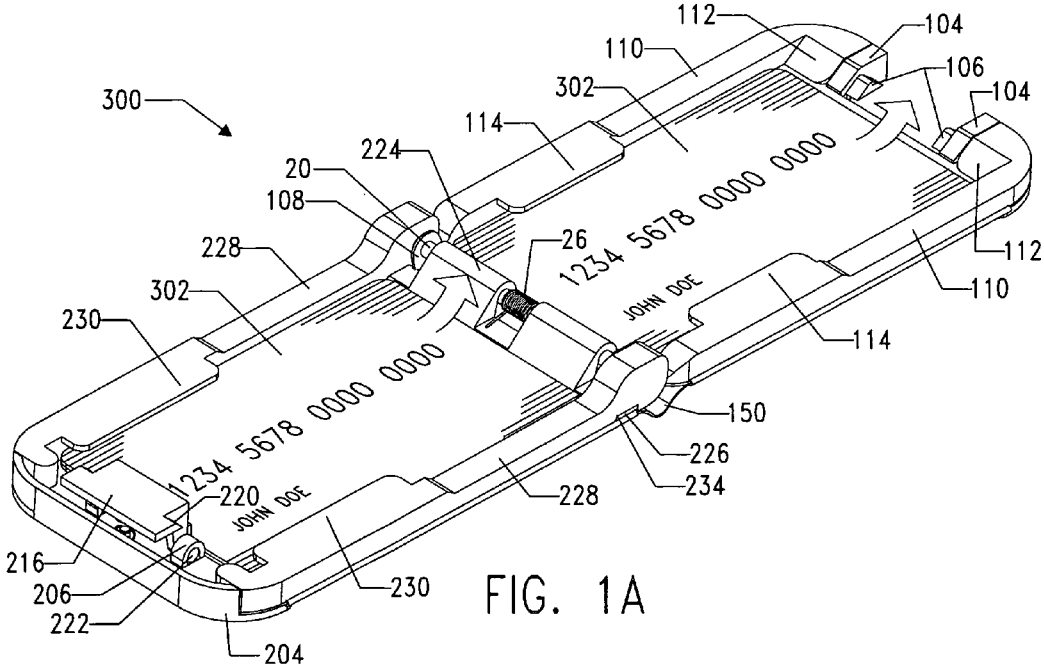
FIG. 1A illustrates schematically an axonometric view of the electromagnetic shielding carrying case when it is in its open state.
Figure 2:
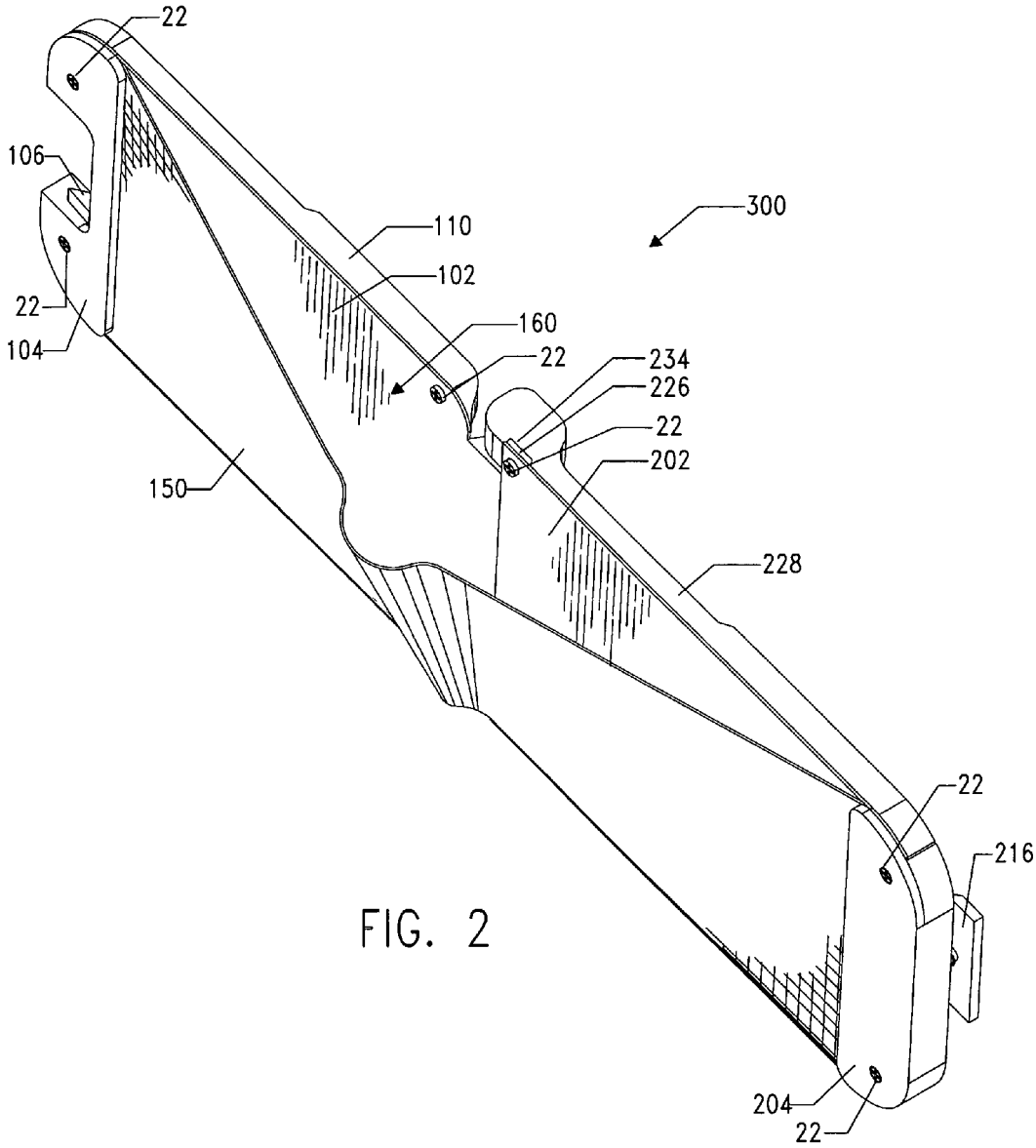
FIG. 2 illustrates schematically an axonometric view of the paper currency pocket on the electromagnetic shielding carrying case when the case is in its open state.

A first card pocket 116 is defined on its sides by front panel wall members 110, its back by hinge members 108, its front by ramp members 112, its bottom by first shielding member 102, and its top by projecting tabs 114. First card pocket 116 is shaped and sized to removably contain a plurality of contactless smartcards 302 or any wallet-sized cards which are slidably inserted and removed in a direction parallel to front panel wall members 110 when electromagnetic shielding carrying case 300 is in a first open position. Ramp members 112 are meant to prevent plurality of contactless smartcards 302 from accidentally sliding out of first card pocket 116. A user may easily slide a card out from first card pocket 116 with their thumb in a direction towards and against ramp members 112 to remove it from electromagnetic shielding carrying case 300 when the case is in its open position (FIG. 1A).

Rear Panel Assembly

Figure 3:
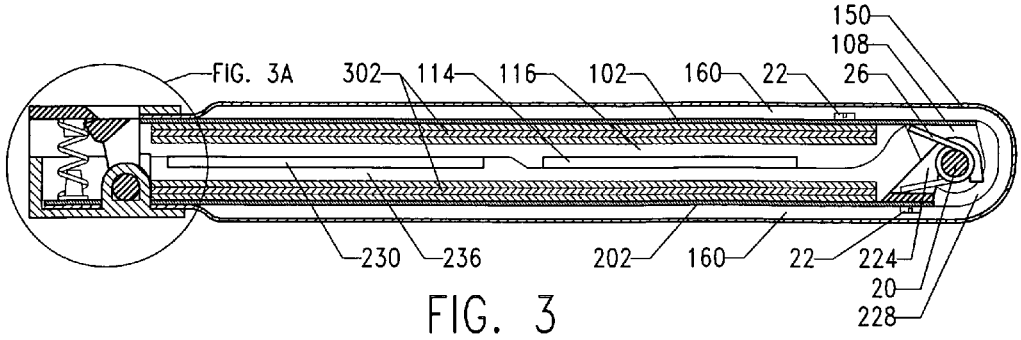
FIG. 3 illustrates schematically a vertical section through the electromagnetic shielding carrying case when the latch member is in its locked position and the carrying case is in its closed state.
Figure 4:
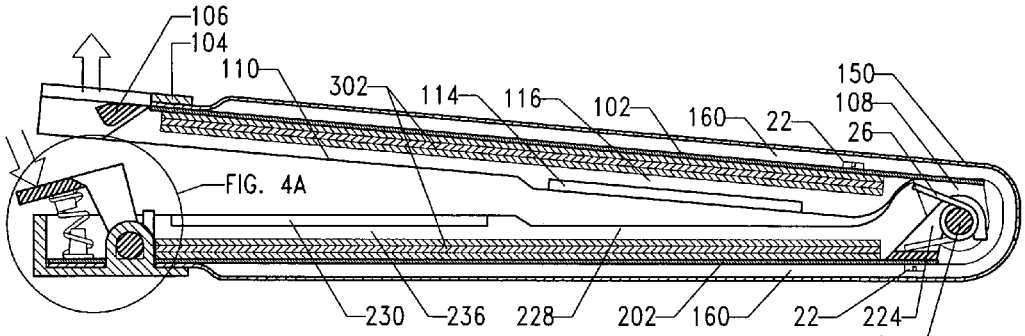
FIG. 4 illustrates schematically a vertical section through the electromagnetic shielding carrying case when the latch member is pressed down and the front panel begins to pivot open.
Figure 8:
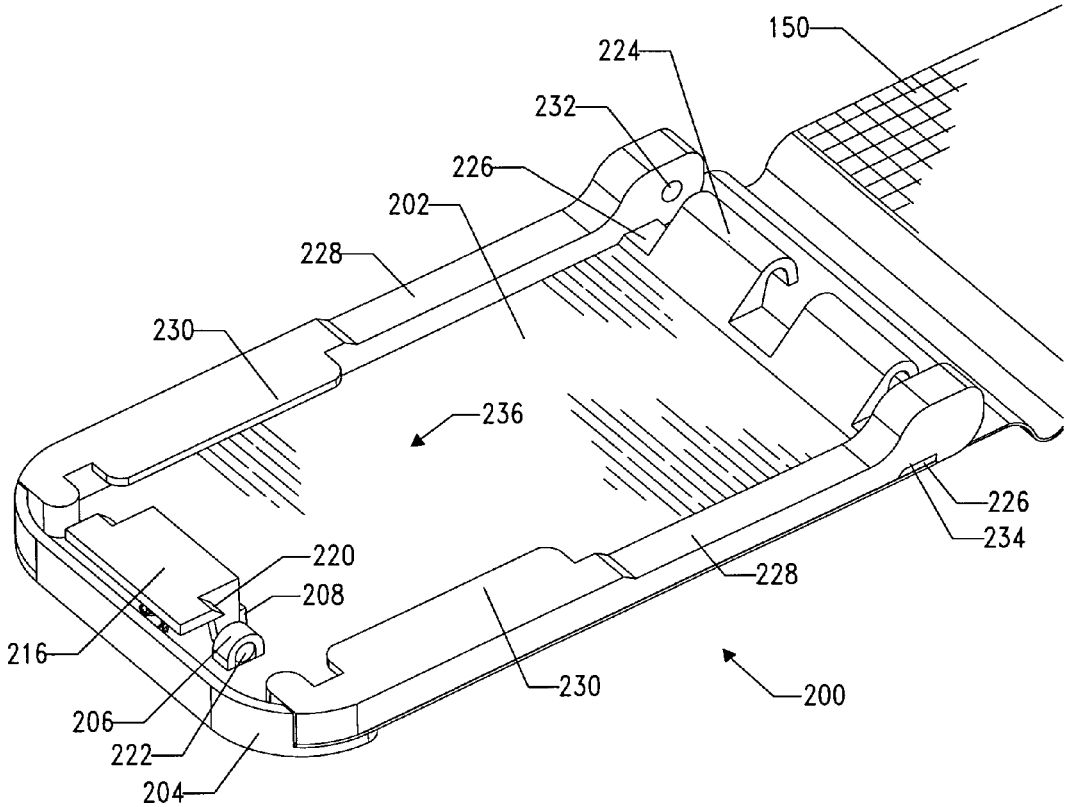
FIG. 8 illustrates schematically an axonometric view of the rear panel assembly by itself and unattached to the front panel assembly.

It should be noted that front panel assembly 100 and rear panel assembly 200 each share a portion of fabric piece 150 to complete their assembly. Rear panel assembly 200, as shown in FIG. 8 and exploded in FIG. 7, comprises a second shielding member 202 which has a planar four sided shape and an inner and outer surface, the outer surface of which is placed against a portion of fabric piece 150. A rear folded portion 154 of fabric piece 150 is folded over onto the inner surface of second shielding member 202 wherein holes in fabric piece 150, holes in second shielding member 202, and holes in rear folded portion 154 are all aligned with each other, and cutouts 212 in fabric piece 150 and cutouts 214 in second shielding member 202 are both generally aligned with each other. Self tapping screws 22 pass through holes in a rear edge plate 204, fabric piece 150, second shielding member 202, rear folded potion 154 and a rear panel ramp member 224 and fasten to screw bosses 238 in the underside of rear panel wall members 228, thus connecting all the same together, as seen in FIG. 7. The screw holes in rear panel ramp member 224 are located on its projecting arms 226 which are sized to be received within notches 234 on the underside of rear panel wall members 228 so it all sits flush against the inner surface of second shielding member 202. A pair of counter-bored holes 232 each sit on an inside portion of the ends of rear panel wall members 228 and receive the ends of hinge pin 20 from front panel assembly 100 as seen in FIG. 7, which hingedly connects rear panel assembly 200 to front panel assembly 100. Counter-bored holes 232 prevent hinge pin 20 from sliding out. One leg of torsion spring 26 pushes against the inner surface of first shielding member 102, and the other leg pushes against a middle portion of rear panel ramp member 224 (as seen in FIGS. 3 and 4) and constantly forces front panel assembly 100 to pivot open away from rear panel assembly 200.

Figure 3A:
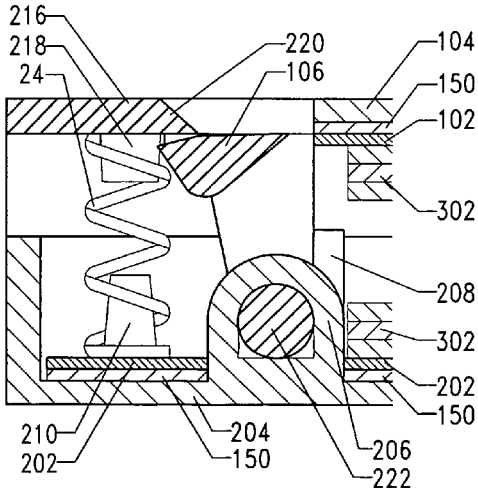
FIG. 3A illustrates schematically an enlarged sectional view of the latch member when it is in its locked position and the carrying case is in its closed state.
Figure 4A:
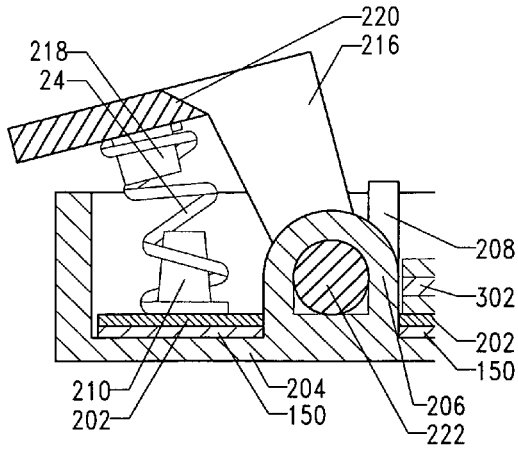
FIG. 4A illustrates schematically an enlarged sectional view of the latch member when it is being pressed down to allow the front panel assembly to pivot open.

Hinge members 206, latch member pivot stops 208, and first spring boss 210 are all upstanding from the inner surface of rear edge plate 204 and all pass through cutouts 212 in fabric piece 150 and cutouts 214 in second shielding member 202, as seen in FIG. 7. A latch member 216 has hinge rods 222 which project from both of its side legs and are pivotally mounted to hinge members 206 on rear edge plate 204. Latch member 216 is preferably molded out of a semi-rigid plastic such as ABS that can flex slightly, so that each leg can be flexed inwards to allow rods 22 to snap into place inside hinge members 206. Latch member 216 also comprises a second spring boss 218 on its underside around which one end of compression spring 24 is inserted, as seen in FIGS. 3, 3A, 4, 4A, and 7B, while the other end of compression spring 24 is inserted around first spring boss 210 on rear edge plate 204. The force of compression spring 24 against the underside of latch member 216 causes it to pivot backwards until it is stopped by pivot stops 208, which keep latch member 216 in a static, locked position as seen in FIGS. 3 AND 3A. Latch member 216 also comprises a pair of tongue overlapping portions 220 on each of its sides.

A second card pocket 236, seen in FIG. 8, is defined on its sides by rear panel wall members 228, its back by pivot stops 208, its front by rear panel ramp member 224, its bottom by second shielding member 202, and its top by projecting tabs 230. Second card pocket 236 is shaped and sized to removably contain a plurality of contactless smartcards 302 or any wallet sized cards which are slidably inserted and removed in a direction parallel to rear panel wall members 228 when electromagnetic shielding carrying case 300 is in a first open position. Rear panel ramp member 224 is meant to prevent plurality of contactless smartcards 302 from accidentally sliding out of second card pocket 236. A user may easily slide a card out from second card pocket 236 with their thumb in a direction towards and against rear panel ramp member 224 to remove it from electromagnetic shielding carrying case 300 when the case is in its open state (FIG. 1A).

Moreover, as rear panel assembly 200 is hingedly connected to front panel assembly 100, a paper currency pocket 160 (seen in FIG. 2) is defined on one side by fabric piece 150, on its other side by the outer surfaces of first shielding member 102 and second shielding member 202, on its bottom edges by front folded portion 152 and rear folded portion 154, on its front edge by the seal created from front edge plate 104 sandwiching fabric piece 150 against the front edge of first shielding member 102, and on its rear edge by the seal created from rear edge plate 204 sandwiching fabric piece 150 against the front edge of second shielding member 202. Fabric piece 150 tightly wraps around the outer surfaces of first shielding member 102 and second shielding member 202 when carrying case 300 is in its closed state, preventing paper currency inside paper currency pocket 160 from falling or sliding out. Paper currency pocket 160 is able to contain paper currency, receipts, tickets, and the like.

Thus, it will be observed that electromagnetic shielding carrying case 300 has two basic states:

(i) Closed State (FIGS. 1, 3, 3A, and 5): As electromagnetic shielding carrying case 300 is pivoted closed, projecting tongues 106 on front edge plate 104 frictionally engage tongue overlapping portions 220 on latch member 216 and cause latch member 216 to pivot forwards to its unlocked position, which can be seen in FIGS. 4 and 4A. As projecting tongues 106 continue to move clear past tongue overlapping portions 220, the urging force of compression spring 24 on the underside of latch member 216 pushes tongue overlapping portions 220 on top of projecting tongues 106, whereby electromagnetic shielding carrying case 300 is able to stay firmly shut in its closed state. This also allows a user to quickly and easily lock carrying case 300 shut without the use of buttons or zippers. Moreover, as observed from FIGS. 3 and 5, it is physically impossible for cards to fall or slide out of the case 300 when it is in its closed state as they are bounded on all sides by elements of the construction.

In the closed state, plurality of contactless smartcards 302 which are contained in first card pocket 116 and second card pocket 236 are sandwiched between first shielding member 102 and second shielding member 202 (seen FIGS. 3 and 5), so that plurality of contactless smartcards 302 are shielded from being scanned by an RFID reader, thereby preventing unauthorized or accidental access to one's personal card data. Moreover, in the closed state, electromagnetic shielding carrying case 300 is securely shut and cannot pivot open while its shifting around in ones pocket or bag, thus avoiding the creation of a breach in the electromagnetic shielding effect, and also preventing any contactless smartcards contained in carrying case 300 from falling or sliding out, which would also risk unauthorized scanning.

Also in this closed state, fabric piece 150 wraps tightly around the outer surfaces of first shielding member 102, second shielding member 202, and the ends of rear panel wall members 228, causing paper currency pocket 160 to close up (see FIG. 3) and grip paper currency, receipts, or tickets that may stored inside it so they do not fall or slide out.

(ii) Open State (FIGS. 1A and 2): From its closed state, electromagnetic shielding carrying case 300 will automatically pivot itself open when ones finger is pushed down on top of latch member 216 causing it to pivot forwards and remove tongue overlapping portions 220 from on top of projecting tongues 106, as seen in FIG. 4. The urging force of one of the legs of torsion spring 26 against the inner surface of first shielding member 102 causes front panel assembly 100 to pivot open approximately 180 degrees until the back edge of first shielding member 102 is flush against the back edge of second shielding member 202, which can be seen in FIG. 2. While in this open state, cards stored in first card pocket 116 and second card pocket 236 can be slidably inserted and removed with ones thumbs while carrying case 300 is held in the palm of one's hand. Moreover, when carrying case 300 is in its open state, fabric piece 150 uncoils from around the outer surfaces of first shielding member 102, second shielding member 202, and the ends of rear panel wall members 228 and opens up paper currency pocket 160 (see FIG. 2) so that paper currency, receipts, tickets and the like can be inserted and removed from within it.

Materials and Manufacturing

In the preferred embodiment, first shielding member 102 and second shielding member 202 are preferably laser cut from a flat sheet of uniform thickness of aluminum alloy. As would be obvious to one skilled in the art, aluminum alloy inherently has strong electromagnetic signal blocking properties, good strength and rigidity, is very lightweight, and readily available at a reasonable price. It is also one of the most readily recycled metals, making it a greener material. The lightness of the material is also favorable because carrying case 300 is meant to be carried in ones pocket or bag comfortably. Hinge members 108 on first shielding member 102 would initially be flat when the whole part is laser cut, but post-laser cutting they are easily bent or formed upwards at a 90 degree angle to the rest of first shielding member 102. As discussed earlier, it's important that shielding members 102 and 202 are made from a durable, resilient sheet of metal instead of a specialized, expensive electromagnetic shielding foil or film in order to eliminate the threat of the shielding material bending, flaking, or tearing over time with use, which is one of the disadvantages of the aforementioned prior art.

Also in the preferred embodiment, front panel wall members 110, front edge plate 104, rear panel wall members 228, rear edge plate 204, latch member 216, and rear panel ramp member 224 are all injection molded out of a durable, lightweight, and resilient plastic such as polypropylene or ABS plastic. This again helps to add to the lightness of carrying case 300 so it can be comfortably carried in ones pocket or bag. Also in the preferred embodiment, hinge pin 20 is preferably made from a lightweight, semi-rigid and durable machine plastic that has good abrasion resistance, such as nylon, to better endure the rotational friction of opening and closing the carrying case 300.

As opposed to fabric piece 150 taking all the stress from being the main connective component that holds carrying case 300 together, front panel assembly 100 and second panel assembly 200 pivot with each other on an actual machine hinge to handle the majority of the rotational stress, which helps to prevent the fraying, stretching and tearing of the fabric that traditional wallets undergo over time with use. This is why fabric piece 150 is preferably made from a very thin, comfortable fabric material such as nylon, cotton, or a thin resilient rubber in the preferred embodiment. As would be obvious to one skilled in the art, fabric piece 150 can also be easily and cheaply laser cut to precisely fit into front panel assembly 100 and rear panel assembly 200, and could also be made of different colors to change the outer appearance of the carrying case 300 and satisfy new trends, tastes, and demands of the market.

SUMMARY, RAMIFICATIONS, AND SCOPE

Accordingly, the reader will see that electromagnetic shielding carrying case for contactless smartcards and personal articles can be used to prevent unauthorized or accidental access to the contents of a plurality of contactless smartcards contained within it, and will not accidentally pivot open while contained in ones pocket or bag. Furthermore, the electromagnetic shielding carrying case has additional advantages in that:

The releasable locking means on the front of the carrying case can be easily unlocked by pushing the latch member down with ones finger, which instantly forces the carrying case to automatically pivot itself open, allowing the user to open the carrying case with minimum effort. Moreover, a user can scan a contactless smartcard without ever removing it from inside the carrying case by disengaging the locking means and allowing the case to flip itself open and hold itself open for them while they hold it up to an RFID sensor or scanner;

A plurality of wallet-sized cards, which may include contactless smartcards, can be contained in more than one card pocket, and are physically prevented from accidentally falling or sliding out of the electromagnetic shielding carrying case when it is in a closed state;

The card pockets within the electromagnetic shielding carrying case are minimal, gripping only a small portion of the edges of the topmost card, which allows a user greater visibility of the topmost card in each card pocket, and is helpful for sorting through cards in dimly lit environments or for people with poor vision. Moreover, this feature can also allow a user to display their driver's license or other cards without ever removing it from the carrying case;

The electromagnetic shielding members within the carrying case also help to prevent the magnetic strips on cards from being demagnetized by external magnetic sources such as speakers, magnets, cell phones and the like when the carrying case is in its closed state;

In addition to holding and shielding a plurality of contactless smartcards, the electromagnetic shielding carrying case has a paper currency pocket for storing paper currency, receipts, tickets, and the like;

Instead of using thin, flimsy electromagnetic shielding foil like some of the prior art, the shielding members within the proposed electromagnetic shielding carrying case are rigid, durable, and hingedly connected to each other, and can cleanly pivot open from one another as opposed to being folded over itself and cracking or breaking with use;

The outer fabric piece can be made in different colors, textures, and prints to meet the current trends, demands, and tastes of the market;

The market for contactless smartcards could be expanded by this invention by assuaging a card owners concerns over privacy and security by giving them the ability to protect the information on their contactless smartcards, which may include RFID enabled debit, credit, or building entry cards.

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Accordingly, the scope of the invention should be determined not by the embodiment illustrated, but by the appended claims and their legal equivalents.

I claim:

1. An electromagnetic shielding carrying case for contactless smartcards and personal articles, the electromagnetic shielding carrying case comprising:

(a) a substantially rigid first electromagnetic shielding member that is generally rectangular in shape having an area that substantially covers a contactless smartcard, and has first, second, third, and fourth sides as well as an outer surface and an inner surface, said first and third sides being substantially parallel to one another and said second and fourth sides being substantially parallel to one another;

(b) a first card holding means affixed to said inner surface of said first electromagnetic shielding member and being adapted to removably contain a plurality of contactless smartcards and other wallet-sized cards;

(c) a substantially rigid second electromagnetic shielding member that is generally rectangular in shape having an area that substantially covers a contactless smartcard, and has first, second, third, and fourth sides as well as an outer surface and an inner surface, said first and third sides being substantially parallel to one another and said second and fourth sides being substantially parallel to one another;

(d) a second card holding means affixed to said inner surface of said second electromagnetic shielding member and being adapted to removably contain a plurality of contactless smartcards and other wallet-sized cards;

(e) hinge means for rotatably linking said first electromagnetic shielding member to said second electromagnetic shielding member along their respective said second sides;

(f) a paper currency holding means for storing paper currency, receipts, and the like having means for attachment to a portion of said outer surfaces of said first and second electromagnetic shielding members;

(g) a releasable locking means for selectively maintaining said first electromagnetic shielding member pivoted closed and over top of said second electromagnetic shielding member allowing them to sandwich said plurality of contactless smartcards that may be contained in said first and second card holding means, whereby said smartcards are shielded from being scanned by a radio frequency identification reader or sensor, and further whereby said releasable locking means consistently keeps said electromagnetic shielding carrying case in a closed state so as to prevent a gap from forming in the electromagnetic shielding effect;

(h) an urging means having a constant force against a portion of said inner surface of said first electromagnetic shielding member whereby upon disengaging said releasable locking means said first electromagnetic shielding member will automatically pivot itself open and away from said second electromagnetic shielding member and hold itself open allowing said electromagnetic shielding carrying case to be in an open state to assist a user in accessing cards and paper currency.

2. The electromagnetic shielding carrying case according to claim 1, wherein said paper currency holding means further comprises:

(a) a length of material spanning across and substantially covering said outer surfaces of said first and second electromagnetic shielding members, said length of material further comprising a front edge having means for attachment to a portion of said outer surface of said first electromagnetic shielding member adjacent to its said fourth side wherein a front seal is formed, and a rear edge having means for attachment to a portion of said outer surface of said second electromagnetic shielding member adjacent to its said fourth side wherein a rear seal is formed;

(b) said length of material further comprising a folded portion that wraps around said first sides of said first and second electromagnetic shielding members and has means for attachment to a portion of said inner surfaces of said first and second electromagnetic shielding members;

(c) wherein a pocket is defined by said length of material, said outer surfaces of said first and second electromagnetic shielding members, said front and rear seals, and said folded portion whereby said pocket has an opening along said third sides of said first and second electromagnetic shielding members and is able to contain paper currency, receipts, tickets, and the like.

3. The electromagnetic shielding carrying case according to claim 2, wherein said length of material is made from a lightweight, durable fabric such as nylon, cotton, polyester, rubber, or leather.

4. The electromagnetic shielding carrying case according to claim 1, wherein said releasable locking means further comprises:

(a) a generally rectangular notch in said fourth side of said first electromagnetic shielding member;

(b) a front edge member shaped to wrap around said rectangular notch comprising a pair of protruding tongues that extend into said rectangular notch, said front edge member having means for attachment to a portion of said outer surface of said first electromagnetic shielding member along said fourth side of said first electromagnetic shielding member;

(c) a rear edge member having means for attachment to a portion of said outer surface of said second electromagnetic shielding member along said fourth side of said second electromagnetic shielding member, said rear edge member further comprising a latch receiving base portion that protrudes through a hole portion of said second electromagnetic shielding member and is upstanding from said inner surface of said second electromagnetic shielding member adjacent to its said fourth side;

(d) a latch member hingedly connected to said latch receiving base portion, said latch member further comprises tongue overlapping portions that suppress said projecting tongues when said carrying case is in said closed state, said latch member further comprises a finger engaging surface which sits within said rectangular notch when said carrying case is in said closed state;

(e) a compression spring held in place by a portion of said latch receiving base portion which urges against the underside of said latch member and keeps it in a locked position;

(f) whereby a user is able to disengage said releasable locking means by pushing down on said finger engaging surface causing said latch member to temporarily pivot forwards and remove said tongue overlapping portions from on top of said projecting tongues allowing said electromagnetic shielding carrying case to pivot itself open to an open state by virtue of said urging means.

5. The electromagnetic shielding carrying case according to claim 1, wherein said hinge means further comprises:

(a) at least one hinge member affixed to said second side of said first electromagnetic shielding member, said at least one hinge member having a hole defined therethrough;

(b) at pair of hinge members protruding from said second side of said second electromagnetic shielding member, said pair of hinge members each having a counter-bored hole on an inner portion;

(c) and a hinge pin inserted through said hole of said at least one hinge member and is received within said counter-bored holes of said pair of hinge members to rotatably link said first and second electromagnetic shielding members along their respective said second sides.

6. The electromagnetic shielding carrying case according to claim 1, wherein said first and second card holding means further comprises:

(a) a pair of wall members affixed along said first and third sides of said first and second electromagnetic shielding members on their respective said inner surfaces, said wall members each comprising a projecting tab that extends over top of said inner surfaces of said first and second electromagnetic shielding members that suppress said plurality of contactless smartcards against said inner surfaces of said first and second electromagnetic shielding members;

(b) a barrier element at the rear of said card holding means to stop cards from being inserted any further;

(c) and a ramp element at a front opening of said first and second card holding means that prevents cards from accidentally sliding out while said electromagnetic shielding carrying case is in said open state, and whereby a user can slidably remove a card with their thumb by sliding it towards and against said ramp element.

7. The electromagnetic shielding carrying case according to claim 1, wherein said urging means comprises a torsion spring inserted around said hinge pin, said torsion spring further comprising a first leg which pushes against a portion of said inner surface of said first electromagnetic shielding member and a second leg which pushes against a portion of said inner surface of said second electromagnetic shielding member.

8. The electromagnetic shielding carrying case according to claim 1, wherein said first and second electromagnetic shielding members are made from a substantially rigid sheet of metal alloy with inherent electromagnetic shielding properties such as aluminum, steel, tin, silver, or copper.

* * * * *